United States Patent [19]

Gore

[11] Patent Number: 4,823,681

[45] Date of Patent: Apr. 25, 1989

[54] GAS DUCT OUTLET

[76] Inventor: David R. Gore, 3044 S. Akron St., Denver, Colo. 80231

[21] Appl. No.: 176,351

[22] Filed: Mar. 31, 1988

Related U.S. Application Data

[63] Continuation-in-part of Ser. No. 93,536, Sep. 4, 1987, abandoned.

[51] Int. Cl.[4] ..... F24F 13/14

[52] U.S. Cl. ..... 98/40.3; 98/2; 98/40.29

[58] Field of Search ..... 98/2, 40.29, 40.3, 94.2, 98/121.2, 40.2, 40.28; 415/123, 125

[56] References Cited

U.S. PATENT DOCUMENTS

| | | | |
|---|---|---|---|
| Re. 28,650 | 12/1975 | Sisk, Jr. et al. | 98/40.29 X |
| 970,196 | 9/1910 | Dougine | 416/85 |
| 2,196,308 | 4/1940 | Johnston | 98/40.3 X |
| 2,936,693 | 5/1960 | Sweedyk | 98/40.28 |
| 3,186,329 | 6/1965 | Kennedy | 98/40.28 |
| 3,242,846 | 3/1966 | Bunn | 98/40.29 |
| 3,699,873 | 10/1972 | Irvin | 98/40.3 |
| 4,007,673 | 2/1977 | Zaloga | 98/40.3 |
| 4,339,991 | 7/1982 | Asazio et al. | 98/40.29 |

FOREIGN PATENT DOCUMENTS

| | | | |
|---|---|---|---|
| 169529 | 10/1982 | Japan | 98/44.29 |
| 992422 | 5/1965 | United Kingdom | 98/40.28 |

*Primary Examiner*—Harold Joyce

[57] ABSTRACT

A miniature gas duct outlet for automatically and continuously changing the direction of a gas stream. A blade drive wheel is rotated by the gas stream moving through a duct. The blade drive wheel rotates an axle with round blades rigidly mounted at an acute angle to the axle. The moving round blades continuously change the direction of the gas from one extreme angle to another. The blade drive wheel is mounted on a lever which can be turned by operator from drive position to not drive position. The blade drive wheel being in the drive position is positioned partly in the flow of gas through the outlet and is forced to rotate. The blade drive wheel being in the non-drive position is totally out of the flow of gas and motionless. The housing of the outlet has a shape which allows the housing to be mounted pivotally to the duct and also allows to rotate manually the plane of the continuously changing direction of the gas stream.

11 Claims, 5 Drawing Sheets

SECTION A–A

DETAIL 1

GAS DUCT OUTLET

CROSS REFERENCE TO RELATED APPLICATION

This application is a continuation-in-part of my copending application Ser. No. 093,536 filed Sept. 4, 1987 now abandoned.

BACKGROUND OF THE INVENTION

1. Field of Invention This invention relates to ventilation means and air conditioner outlets, where there exists a continuous need for change of direction of the gas stream. It can be installed in a car vent, heat and air conditioning outlets, airplane vent outlets and evaporator outlets.

2. Brief Description of the Prior Art

Outlets of a gas duct that oscillate the direction of stream of gas and use air stream as a drive power are known (See U.S. Pat. Nos.: 4,007;673 of Zaloga and 28,650 of Sisk). They are complicated and relatively large and cannot be employed in small duct systems as car ventilation and air conditioning duct systems.

Therefore, only a few models of luxury cars use an outlet that oscillates the direction a stream of gas. These outlets are relatively complicated, expensive and, as a rule, use electricity as a source of energy.

Except for rare case, all vehicles use outlets of a duct that guide a stream of air in a fixed direction. In order to change the direction of the stream in the existing outlet, one has to turn louvers manually.

It would be advantageous over the prior art to have a simple miniature mechanism which can easily install in the vehicle without substantial increase of their prices.

SUMMARY OF THE INVENTION

The principal object of the present invention is to provide a gas outlet with a simple and cheap mechanism that can automatically and continuously change the direction of the steam of gas. Another object of the invention is to lower the cost of the vent system reducing the number of outlets and ducts.

Still another object of the invention is to use the gas stream power as a driving force for miniature outlet to change the direction of the steam of gas, thus avoiding the need for special sources of energy such as electricity.

A further object of the present invention is to allow a simple design and a low cost stream direction change mechanism which can be built mainly inside the gas duct.

In accordance with the object of the invention a preferable embodiment of an outlet includes: a housing of the outlet, numerous axles mounted on the walls of the housing, fork pivotally mounted on one of the axles, pulleys mounted on the axles, round blades angularly mounted on the front positioned axle, and axle pivotally mounted on the rear end of the fork, a drive blade wheel rotating with the axle on the end of the fork, and belts connecting the driver and driven pulleys.

The axles, drive and driven pulleys and belts comprise a transmission mechanism connecting the drive blade wheel with the axle carrying the round blades.

The rear end of the housing of one of the version of the embodiment has a round shape as well as an end of a duct.

The housing is mounted to the duct pivotally allowing to rotate the housing relatively the duct around the axis of the duct.

This mechanism may also have means of increasing its performance such as:

(a) a brake mechanism arresting the movement of the outlet mechanism and thus fixing direction of the outlet stream;

(b) a variable reducer changing the ratio from the blade drive wheel to the axle with round blades, correspondingly changing the frequency of alternation of the direction of the stream;

DESCRIPTION OF PREFERRED EMBODIMENTS

Figure 1:
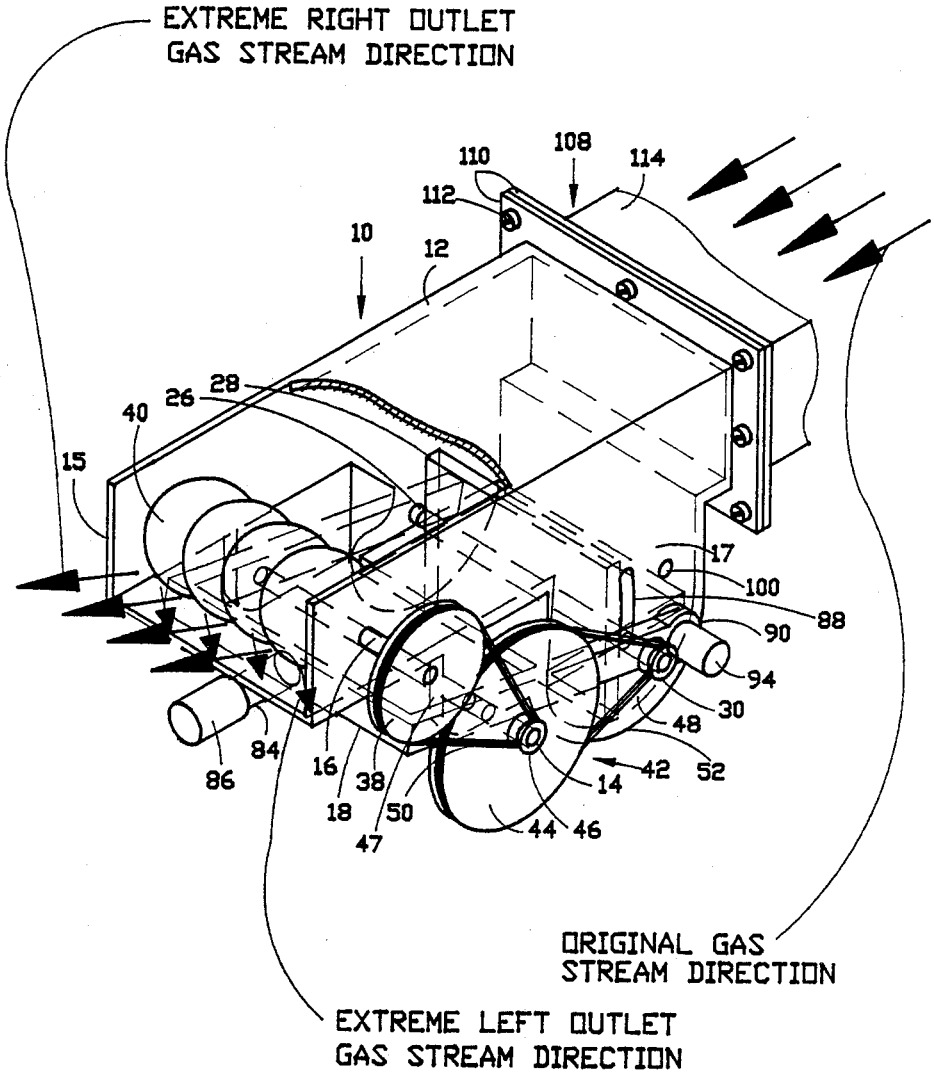
FIG. 1 is a fragmentary perspective view of an outlet utilizing the present invention.

An outlet 10 utilizing the present invention is seen in FIG. 1, 2, 3, and 4. The outlet 10 is consisted of the housing 12, axles 14 and 16 mounted on the walls 15 and 17 of the housing 12, fork 18, pivotally mounted on the axle 14, an axle 26, mounted on the far end of the fork 18, rectangular blades 28 defining a drive blade wheel or paddle wheel, a pulley 30 rigidly fixed to the axle 26, a pulley 38, rigidly fixed on the axle 16, a round disc-type blade or deflector vanes 40, rigidly attached to the axle 16, a double pulley 42, having a large pulley 44 and a small pulley 46, pivotally mounted on the axle 14.

The walls 15 and 17 of the housing 12 have extensions 47 which carry the axle 14 outside of the gas stream path.

The paddle wheel 28 can be positioned into gas stream path of the outlet 10 so that only the upper blades 28 are forced by gas stream to move in the direction of the steam or to rotate counter-clockwise.

A belt 48 passes the rotation from pulley 30 to pulley 44 and consequently to pulley 46. A belt 50 passes the rotation from the pulley 46 to the pulley 38, the axle 16 and the deflector vanes 40.

The pulleys 30, 42, and 38, and the belts 48 and 50 define a transmission mechanism transmitting rotation from the paddle wheel 28 to the deflector vanes 40.

The axles 14, 16, and 26 are coplanar with the bottom of the outlet body 12 and the parallel to one another. The body 12 has a recession 52 on the bottom where approximately all the drive blade wheels can be located. The lower part of the recession 52 has a semiround shape.

Figure 6:
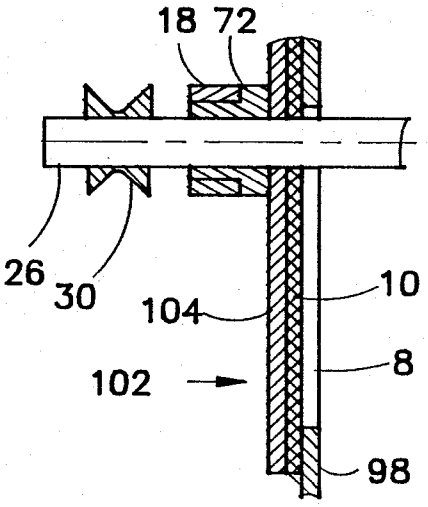
FIG. 6 is a section A—A of FIG. 5.

The axle 26 is mounted in bearings 72 of the fork 18 (See FIG. 6). The axle 14 is mounted on the housing 12 rigidly. The fork 18 is mounted on the axle 14 by bearings 76. The double pulley 42 is mounted on the axle 14 by a bearing 77 (See FIG. 3 and 4). A tooth lock washer 79 prevents the double pulley 42 from moving along the axis of the axle 14. The fork 18 and the double pulley 42 can rotate around the axle 14.

The fork 18 has a bar 84 with a handle 86. The handle 86 is located on the other side of the dashboard and a driver can move it vertically from a very high position to a very low position and vice versa. The inner end 90 of the fork 18 will move from a very low position to a very high position and vice versa. The walls of the housing 12 of the outlet 10 has two slots 88 which allow the axle 26 to move up and down together with the fork 18.

When the inner end 90 of the fork 18, along with the axle 26 and the paddle wheel 28, are located in the upper position, the upper blades of the paddle wheel 28 will be situated in the path of the gas stream and will be forced to rotate and drive the round blades 40 which change the outlet gas stream direction. This position of the parts is shown in FIG. 15 by continuous lines. When the inner end 90 of the fork 18, along with the axle 26 and the paddle wheel 28 are located in a lower position, all blades of the paddle wheel 28 will be outside of the path of the gas stream. In this position the parts of the mechanism will not rotate so the outlet gas stream will blow in a single fixed direction. This direction will depend on the position of the round blades 40 at the moment when the paddle blades 28 were removed from the path of the gas stream. On FIG. 15 this position of the parts is shown by hidden lines. When the inner end 90 of the fork 18, along with the axle 26 and the paddle wheel 28, are located in the upper position, the gas stream moving along the duct 108 and the housing 12 of the outlet 10 pushes the upper rectangular blades 28 and forces them and the axle 26 with the pulley 30 to turn counterclockwise. The pulley 30 drives a double pulley 42. The double pulley 42 drives the pulley 38, axle 37 and round blades 40 by the belt 44. Because of the big ratio between the pulleys 30 and 38, the RPM of the axle 16 with the round blades 40 is much less than the RPM of the axle 26 with drive blades 28.

The flat round blades 40 form having an acute angle "a" with the axle 16. Therefore, the axle 16, turning the round blades 40 relative to the housing 12 of the outlet 10 and the original gas direction, from the angle "a" at the extreme left position to the angle "a", at the extreme right position and vice versa.

Figure 3:
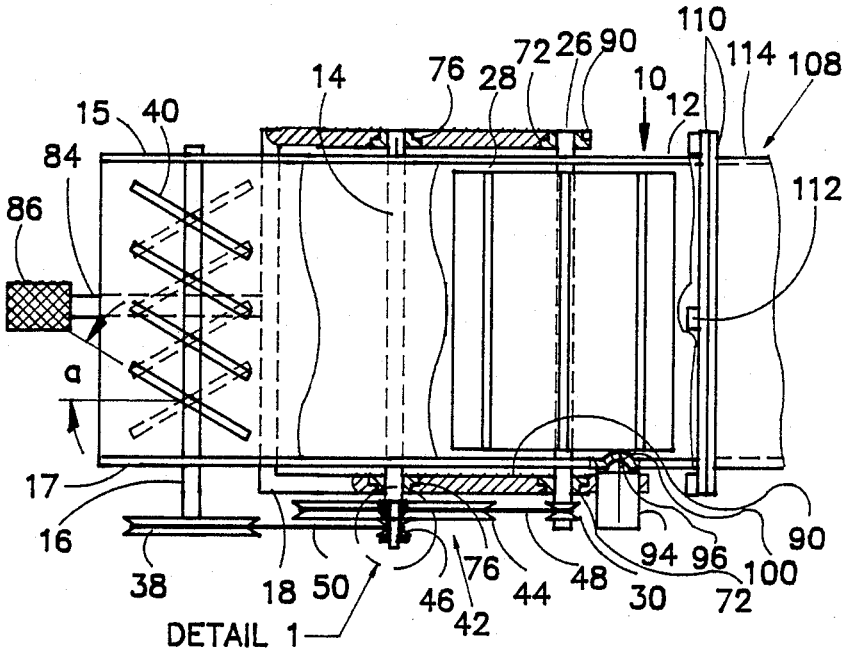
FIG. 3 is a plan view of the outlet.
Figure 2:
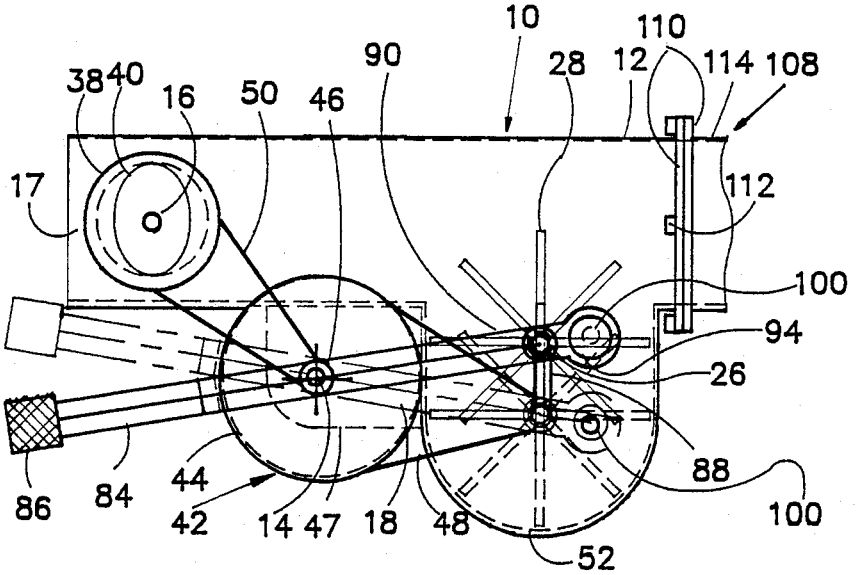
FIG. 2 is a fragmentary elevation view of the outlet.

A detent 94 with a ball 96 is mounted onto the inner end 90 of the fork 18 (See FIG. 3). The ball 96 is pushed by a spring (inside of the detent 94) against the wall 17 which has two depressions 100 accepting the ball 96 when the latter moves into extreme upper or lower positions.

Figure 5:
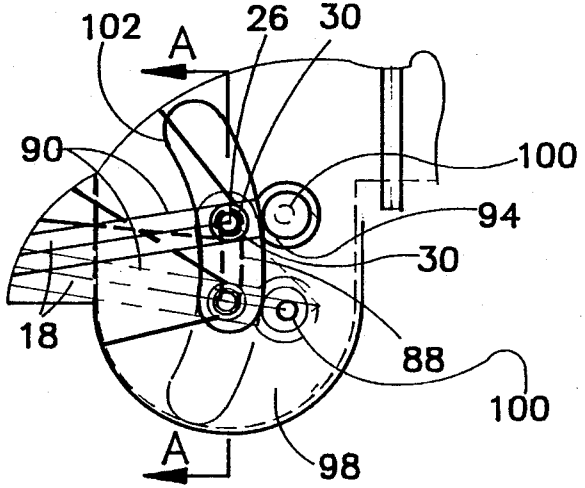
FIG. 5 is a part of the elevation view of the outlet with a cover means.
Figure 4:
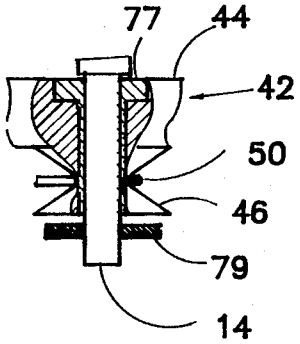
FIG. 4 is an enlarged detail 1 of the drawing FIG. 3.

The part of the outlet embodiment with means covering the slots 88 is shown on the FIG. 5 and 6 (these means are omitted from the FIG. 1, 2, 3, 7 and 8 for clarity).

A cover 102 is mounted on the fork 18. The cover 102 contains two layers: a rigid layer 104 and an elastic layer 106. The elastic layer 106 is pushed against the wall 17 and seals the slot 88 regardless of the position assumed by the paddle wheel l28 and the axle 26.

The body 12 of the outlet 10 is connected to a duct 108 by flanges 110 and screws 112 to a rectangular end 114 of the duct 108.

Figure 7:
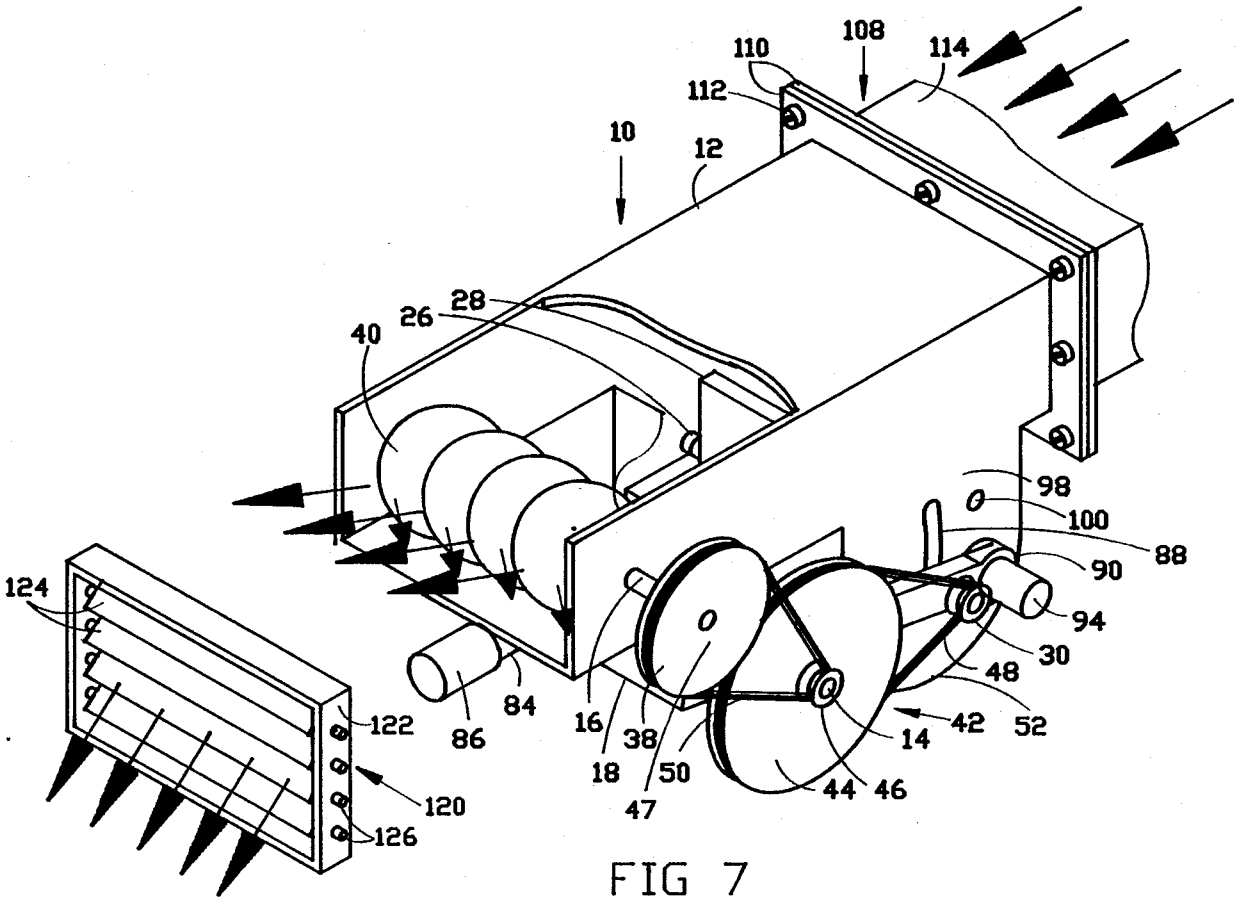
FIG. 7 is a fragmentary perspective view of the outlet with a mechanism of louvers.
Figure 8:
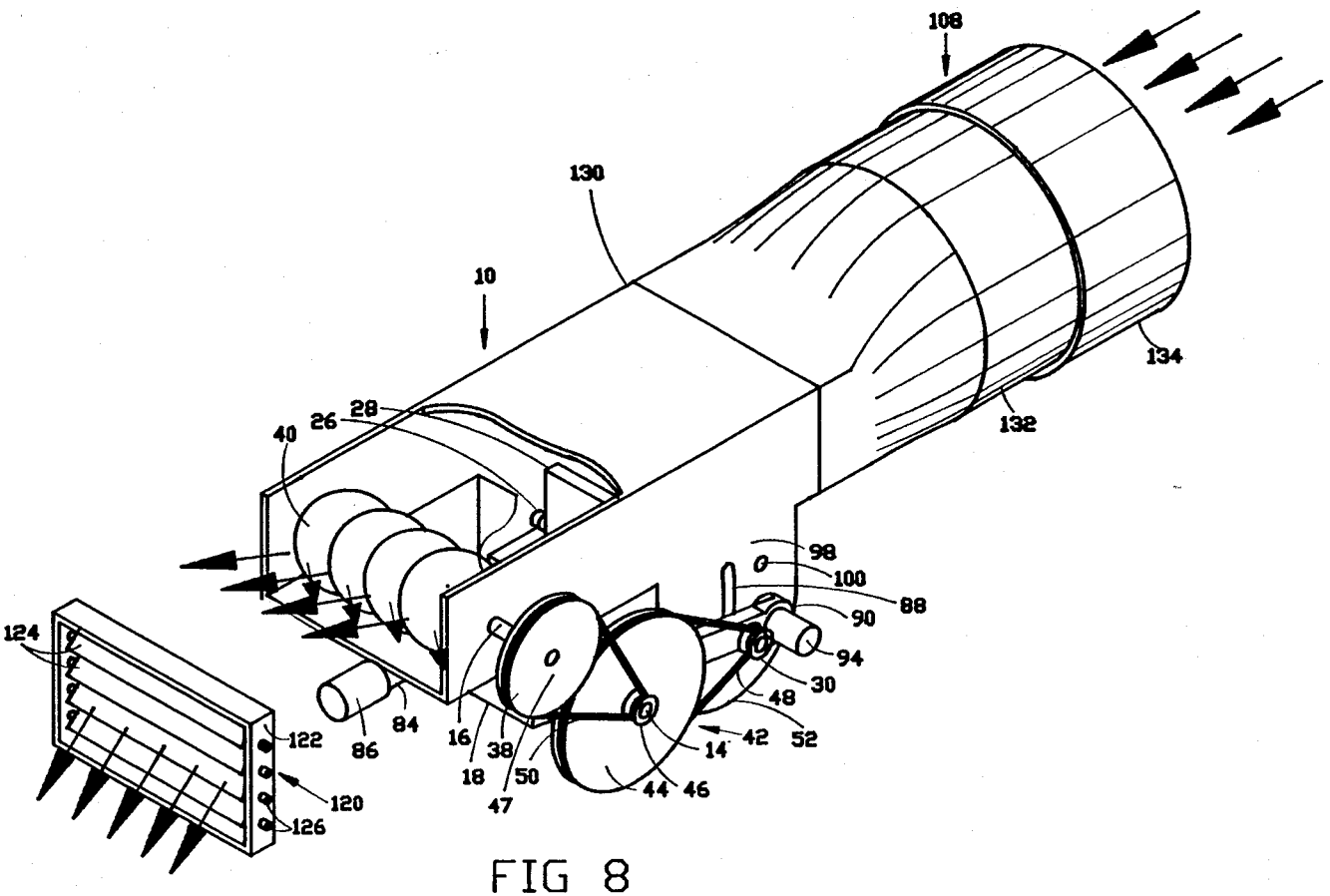
FIG. 8 is a fragmentary perspective view of an outlet accommodated to be turned relative to the duct.

An outlet with louvers in the front of the outlet itself is seen in FIG. 7 and 8. A frame 122 of the louvers mechanism 120 carries a number of louvers 124. The louvers can be rotated around their axles 126, which are positioned in the holes of the frame of the louver mechanism 120. All louvers 124 are connected with one another so they only turn together and they always are parallel to one another (such mechanisms are widely used in vehicles, the drawing does not show it for clarity). The operator can turn the louvers 124 manually into a position he/she needs. That means that the plane in which the outlet changes permanently and continuously the direction of the gas stream can be turned up and down into a different steady position until the next manual operation.

FIG. 8 shows an embodiment of the outlet 10 designed for having the possibility to turn the plane of permanent continuous changing of the direction of the gas stream (for instance, from a horizontal to a vertical position).

In this modification the housing 130 of the outlet 10 ends in cylindrical shape 132 which is mounted in a cylindrical end 134 of the duct 136. The duct 136 holds the outlet 10 by friction and the operator can turn the outlet in another position manually. If he/she turns the housing 130 such as the axis 14, 16 and 26 will be positioned vertically, the stream will automatically and continuously change its direction in a vertical plane from extreme low direction to extreme high direction.

What is claimed is:

1. An outlet for a gas duct to regulate the direction of gas flow out of said duct comprising in combination:

housing means having a gas flow passage therethrough and including an enclosed recession that is not in said gas flow passage, deflector vanes for directing the gas flow out of said outlet, said deflector vanes being mounted in said housing means for selected continuous movement whereby the direction of gas flow out of said outlet can be continuously changed by said deflector vanes, drive means operatively connected to said deflector vanes to continuously change the position thereof, said drive means being positionable at least partially in the gas flow passage whereby said drive means are in fact drivable by said flow of gas, and positioning means carrying said drive means, said positioning means being adapted to move the drive means between a position in the gas flow passage and a position in the enclosed recession.

2. The outlet of claim 1 wherein said positioning means includes a lever and the lever is pivotally mounted on said housing means.

3. The outlet of claim 2 wherein said deflector vanes are mounted angularly on a rotatable shaft disposed in the flow of gas through said duct whereby upon rotation of said shaft the vanes will be moved angularly relative to the flow of gas to continuously change the direction of gas flow out of said outlet.

4. The outlet of claim 3 wherein said deflector vanes are circular discs.

5. The outlet of claim 4 wherein said shaft passes through the center of said circular discs.

6. The outlet of claim 2 wherein said drive means consists of a paddle wheel.

7. The outlet of claim 6 wherein said paddle wheel includes a plurality of blades mounted on a rotatable axle and the axle is mounted on said lever.

8. The outlet of claim 7 wherein said blades are of rectangular configuration.

9. The outlet of claim 2 wherein said outlet further includes a plurality of manually movable louvers for selectively directing the gas stream after it has passed through the deflector vanes.

10. The outlet of claim 2 wherein said housing means has slots defining a path for movement of the axle of said drive means.

11. The outlet of claim 10 wherein said positioning means has a cover means preventing leakage of the gas through said slots.

* * * * *